United States Patent [19]

Osterberg et al.

[11] Patent Number: 4,834,870

[45] Date of Patent: May 30, 1989

[54] METHOD AND APPARATUS FOR SORTING NON-FERROUS METAL PIECES

[75] Inventors: Richard R. Osterberg, Canton; Richard B. Wolanski, Dexter, both of Mich.

[73] Assignee: Huron Valley Steel Corporation, Belleville, Mich.

[21] Appl. No.: 93,197

[22] Filed: Sep. 4, 1987

[51] Int. Cl.[4] ..... B03C 1/30; B03C 1/18; H01F 7/02

[52] U.S. Cl. ..... 209/38; 209/44.1; 209/212; 209/631; 209/636; 209/638; 335/306

[58] Field of Search ..... 209/8, 38, 212, 219, 209/225–227, 631, 638, 636, 642, 44.1; 335/288, 300, 303, 306, 302, 304

[56] References Cited

U.S. PATENT DOCUMENTS

| | | | |
|---|---|---|---|
| 3,448,857 | 6/1969 | Benson et al. | 209/212 |
| 3,454,913 | 7/1969 | Israelson et al. | 335/306 |
| 3,710,291 | 1/1973 | Nicoud | 335/306 |
| 3,824,516 | 7/1974 | Benowitz | 209/212 X |
| 4,070,278 | 1/1978 | Hunter | 209/212 |
| 4,083,774 | 4/1978 | Hunter | 209/212 |
| 4,106,627 | 8/1978 | Watanabe et al. | 209/212 X |
| 4,459,206 | 7/1984 | Laithwaite | 209/3 |

FOREIGN PATENT DOCUMENTS

| | | | |
|---|---|---|---|
| 3416504 | 11/1985 | Fed. Rep. of Germany | 209/212 |
| 3423866 | 1/1986 | Fed. Rep. of Germany | 209/8 |
| 1347498 | 3/1964 | France | 209/212 |
| 52-74168 | 6/1977 | Japan | 209/212 |

*Primary Examiner*—James B. Marbert

*Assistant Examiner*—Edward M. Wacyra

*Attorney, Agent, or Firm*—Harness, Dickey & Pierce

[57] ABSTRACT

Mixed pieces of different non-ferrous metals are sorted by initially moving the pieces through a high density, rapidly changing magnetic flux field, and immediately thereafter, freely moving the pieces along unsupported forwardly and downwardly directed trajectories resulting from the momentum of the pieces, the force of gravity and the magnetically induced repulsive forces developed in the pieces by the flux field. The magnitude of the magnetically induced repulsive forces differ for different non-ferrous metals so that the lengths of the trajectories of generally similar size and shape pieces vary accordingly for separating pieces formed of different metals. The magnetic field is provided by a horizontally axised, rapidly rotating, hollow, liquid cooled, iron wall drum having magnets affixed to its outer surface. The magnets are arranged in rows that are formed of numerous, tile-like, small, permanent magnets which are positioned end to end, with their like polarity ends adjacent. A belt conveyor, which moves the pieces across the top of the drum, has its discharge end pulley coaxially surrounding the drum so that the pieces freely move off the end of the conveyor belt after passing through the magnetic field. Hence, the lengths of the trajectories may be controlled by adjusting the speed of the conveyor, which adjusts the momentum of the pieces, and by adjusting the rotational speed of the drum for adjusting the frequency of the changes in the magnetic field and, consequently, the magnitude of the induced repulsive forces.

18 Claims, 2 Drawing Sheets

METHOD AND APPARATUS FOR SORTING NON-FERROUS METAL PIECES

BACKGROUND OF INVENTION

This invention relates to a method and apparatus useful for sorting or separating mixtures of pieces of different metals. It is particularly useful in the sortation of mixtures of irregular, varying size and shape, varying composition, pieces of scrap metal such as shredded automobile scrap metal.

Discarded automotive vehicles are typically broken and shredded into scrap metal pieces. These pieces comprise different metals since different parts of an automotive vehicle are made of different metals. For example, the scrap metal pieces may comprise pieces of ferrous metals, aluminum, zinc, copper, brass, lead, stainless steel, as well as non-metallic pieces of plastic, glass and even stones or rocks.

For the most part, scrap handlers can remove the ferrous metal materials from the mixtures of diverse pieces by utilizing magnets. However, after the removal of ferrous metals by ordinary electromagnets, the remaining mixtures of diverse pieces are of very low value since they cannot be reused as raw materials until the different kinds of materials are separated one from another. Different separation systems have been utilized in the past, such as melting the scrap and separating the material through smelting or chemical processes. Alternatively, separation of the materials has been done by hand utilizing low cost manual laborers to simply visually recognize pieces of different materials and to manually separate these materials.

For economically feasible manual separation, mixtures of different materials are shipped to low labor cost areas of the world, as for example, to a low cost labor oriental country. There, individuals visually select different kinds of material pieces, such as valves, handles, connectors, trim, etc., and manually separate these pieces which are known to be made of different metals. Hence, a piece of a part that is made of zinc or a piece of another part that is made of aluminum can be visually recognized and manually separated.

Once the scrap pieces are separated or sorted into similar metal categories, they can be utilized as raw material by re-melting them reusing the metal. At the same time, non-metallic materials, such as plastic pieces, glass fragments, rocks and the like, can be separated for discarding in a land fill or the like. The value of scrap that is separated into separate types of metals, is considerably greater than, and such scrap is more usable than, mixtures of diverse scrap pieces.

The expense of separating or sorting the mixtures of scrap pieces is considerable. In the case of the utilization of low cost labor, the material often must be shipped considerable distances and then, after sorting, the materials must be returned to places where they can be melted and re-used as raw materials. This transportation is relatively costly. In the case of separation by smelting type processes, considerable expense is involved in the equipment and the processing. Thus, there has been a need for a method and an apparatus for less expensively sorting or separating mixtures of scrap metal materials comprising materials that are left after the removal of iron pieces by the usual magnetic devices which attract the magnetically attractable ferrous materials.

The invention of this application focuses on a system for physically separating mixed pieces of non-ferrous metals, which normally are not amenable to magnetic separation, by utilizing magnetic forces, so as to substantially eliminate the need for manual labor.

SUMMARY OF INVENTION

This invention contemplates a method by which ordinarily nonmagnetically attractive metal materials are separated, in accordance with their metal categories, by passing pieces of such material through a rapidly changing, high flux density, magnetic field which momentarily induces eddy currents in the pieces to produce repulsive magnetic forces that are proportional to the types of metals. The moving pieces are released, upon passing through the magnetic field, to freely continue their movement, without support, under the influence of their momentum, the force of gravity and the magnetic repulsion between their induced magnetic forces and the magnetic field. As a result, the pieces freely move along a forwardly and downwardly directed trajectory. The distance of movement of each piece correlates to the type of metal of which the piece is made. That is, different metals have different magnetically induced forces so that the pieces of different metals tend to have longer or shorter trajectories. The separated metal pieces are collected along their trajactories of movement.

The forces which move the pieces are dependent upon the size, shape and mass of the individual metal pieces. Consequently, the metal scrap pieces are first, roughly sorted by size, using mechanical sorting equipment, such as vibratory sorting screens or the like. Then, pieces of generally the same size are sorted by the equipment of this invention. Because the sizes and surface areas of each piece affect the amount of induced magnetic force in that piece, in practical operation, the sortation is best accomplished by repeating the cycles of sortation steps a number of times for partially sorting the pieces in each cycle. For example, the entire collection of pieces in the initial mixture may be separated into groups of pieces which respond about the same amount to the first cycle of sorting. However, each group contains pieces made of a number of different metals. Then, each of the groups may be recycled to separate them into subgroups which contain pieces of one or more than one different metals. Again, each subgroup is recycled until the subgroups comprise only one kind of metal. In the course of such sortation, any ferrous metal materials, including non-magnetically attractable ferrous metal materials, such as stainless steel, and also any nonmetallic pieces, such as plastics, glass and stones, are gravity removed from the mixture because they do not move along trajectories like that of the non-ferrous metal pieces.

In order to provide the rapidly changing, high density, magnetic flux field through which the mixture pieces are rapidly passed, a magnetic rotor is provided. This rotor is surrounded by a conveyor belt pulley that supports the discharge end of a conveyor belt upon which the pieces are moved. However, the rotor rotates considerably faster than does the conveyor belt pulley. The rotor has numerous rows of small size permanent magnets adhesively secured to its peripheral surface. The magnets are arranged end to end, with like polarity adjacent each other, in each row and each row is longitudinally offset relative to its adjacent row. This arrangement forms numerous rows of numerous separate magnetic fields, corresponding to each magnet, with the fields offset from one row to another. Hence, rapid rotation of the rotor produces a composite rapidly changing magnetic flux field in the area where the pieces pass upon the conveyor belt. After passing through the magnetic field, the pieces are released, i.e., are no longer supported upon the belt, for free movement in response to inertia and gravity as well as due to the repulsive magnetic forces caused by eddy currents induced in each piece by the changing magnetic field.

One object of this invention is to provide a rapidly changing, high density magnetic field,through which the pieces are passed, by means of a rotatable rotor formed of a hollow drum upon whose surface are affixed a large number of small permanent magnets. Thus, rotation of the drum, at relatively high speeds, produces a rapidly changing magnetic flux field as each magnet swings past the support conveyor upon which the pieces are moved above the rotating drum. Also, because the changing magnetic field produces considerable heat which can ruin the magnets, the drum or rotor is made so that it can be easily cooled by flowing water through its interior.

A further object of this invention is to provide a relatively simple, rugged system by which mixtures of pieces of scrap metals and other intermixed materials, can be rapidly sorted, one from another, by means of inducing magnetic forces on the pieces and causing the pieces to separate into different categories by letting them move in free-falling trajectories relative to each other under the influence of their induced magnetic forces, gravity and inertia.

Another object of this invention is to provide equipment which performs a cycle of steps for sorting mixed pieces made of different kinds of materials, and for repeating the cycle of sorting steps until, ultimately, the pieces are separated by rough size and metallic composition.

These and other objects and advantages of this method and the equipment for performing the method will be described in greater detail in the following description, of which the attached drawings form a part.

DETAILED DESCRIPTION

Figure 1:
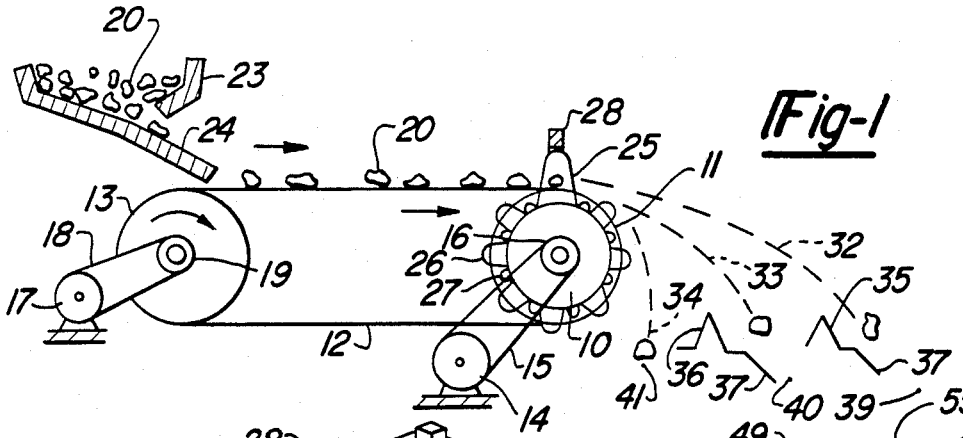
FIG. 1 illustrates a schematic view of the apparatus.
Figure 2:
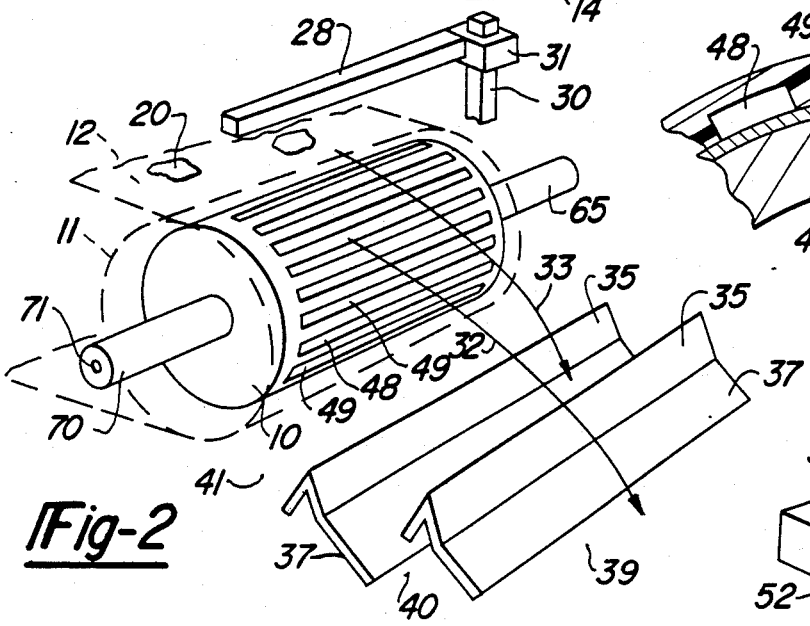
FIG. 2 is a perspective, schematic view of the rotor, conveyor, dipole and discharge end portion of the apparatus.
Figure 6:
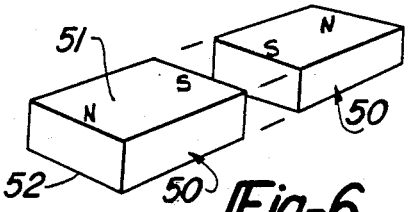
FIG. 6 is a perspective view of two adjacent magnets, arranged end to end, but separated before affixing them upon the rotor surface.

FIGS. 1 and 2 illustrate a rotor 10 which is surrounded by the tail, or discharge end, pulley 11 of a conveyor. The endless conveyor belt 12 of the conveyor extends around a head pulley 13. Additional pulleys or conveyor rollers may be used to support the conveyor belt, but are omitted here for illustration purposes.

The rotor is rapidly rotated by means of a rotor motor 14 (shown schematically) which may be connected by a belt 15, or by suitable gears or chain connections, to a rotor pulley 16 or chain sprocket or gear. The conveyor head (or tail) pulley is rotated by means of a motor 17, connected by a belt 18 to a pulley 19 on the rotor pulley. As in the case of the rotor, the conveyor pulley may be driven by a chain or by suitable gears (not illustrated). Both motors have variable speed control drives so that their speeds may be adjusted. Significantly, the conveyor pulley is rotated at significantly lower speeds than the rotor.

A mixture of pieces 20, which are to be sorted, may be contained within a hopper 23, or carried by a suitable conveyor belt, through a feed trough 24 upon the upper surface of the conveyor belt 12. The pieces 20, which are spread out upon the conveyor belt surface in a single thickness layer, move through a rapidly changing, high flux density magnetic field 25 located above the rotor. The field is a composite of separate high fields 26 and lower fields 27 (i.e. relative to the rotor surface) and an upwardly extended field portion which results from the action of a dipole 28 located above the rotor.

The dipole 28 maybe formed of an iron bar upon which a row of small, permanent magnets 29 are affixed. The dipole bar is connected to dipole supports 30 located at opposite ends of the rotor. For illustration purposes,. one dipole support, schematically shown in the form of an upwardly extending post, is illustrated. The end of the dipole bar 28 is connected to an adjustable clamp 31 which, in turn, is connected to the post so that the height of the dipole may be selectively varied. The height of the dipole above the rotor affects the magnitude of the flux density of the field immediately above the rotor and the conveyor belt.

The pieces that are to be separated pass through the composite magnetic field 25 and then are no longer supported by the belt so that their continued forward motion is unsupported. Thus, the freely continued motion of the pieces,under the influence of their inertia or momentum, gravity, and magnetic forces induced in the pieces by the field, results in travel trajectories which vary between different size and different material pieces. For illustration purposes, these trajectories are illustrated as a far trajectory 32, a closer trajectory 33, and little or no trajectory 34 which define the separate paths of travel of different pieces.

Splitters or separators 35 are arranged transversely of the paths of the trajectories of the pieces. Slides or troughs 37 guide the pieces into separated collection locations 39, 40 and 41 beneath and between the splitters. These locations may actually comprise conveyor belts for removing the pieces from the collection locations or hoppers or the like (not shown).

Figure 5:
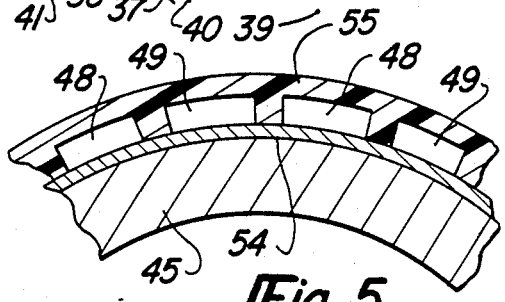
FIG. 5 is an enlarged, fragmentary, cross-sectional end view of the rotor drum and rows of magnets.
Figure 4:
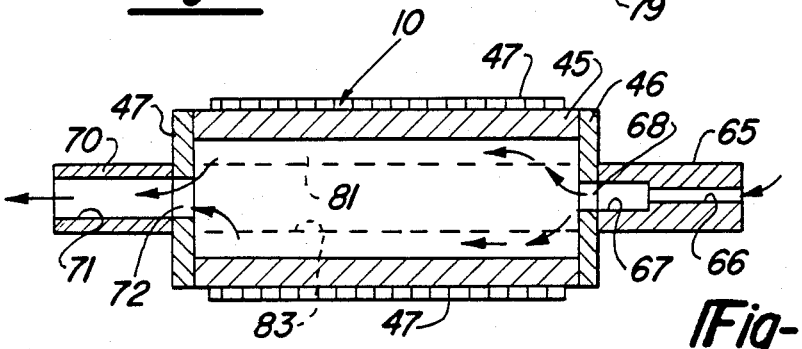
FIG. 4 is a cross-sectional view, similar to FIG. 3, illustrating the rotor in cross-section.
Figure 7:
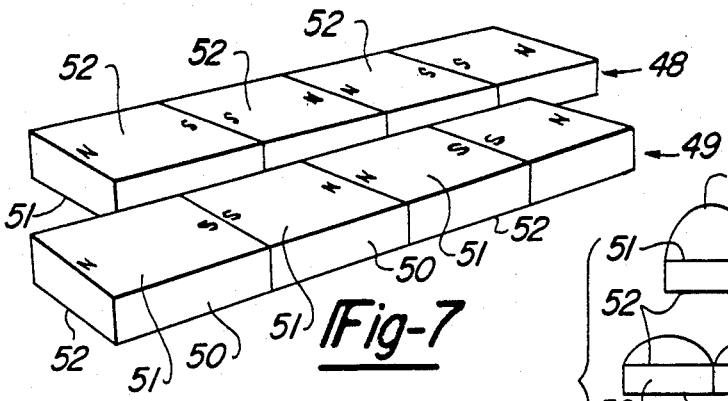
FIG. 7 is a perspective, enlarged view, of two adjacent rows of magnets.

The rotor 10 is formed of a hollow drum, preferably formed of a magnetizable iron. The wall 45 of the drum is schematically illustrated in FIGS. 4 and 5. The opposite ends of the drum are closed by end closures or end plates 46 and 47 so that the drum is formed for containing a liquid coolant, such as water.

Alternating rows 48 and 49 that are formed of numerous permanent magnets 50 are affixed upon the exposed outer surface of the drum wall 45. These magnets 50 are formed in a block-like or flat domino-like shape. They are arranged end to end in each row, with their like polarities adjacent. That is, the south ends of each adjacent pair blocks are arranged together, as are the north ends, etc. Such magnets tend to have a stronger flat face 51 and a weaker flat face 52. Thus, the stronger and weaker faces of the magnets in each row are arranged coplanar. But, the alternate rows are reversed so that the stronger faces of the magnets in one row are adjacent the wall 45 of the drum, while the magnets in the next alternating row have their corresponding strong faces exposed away from the drum.

The magnets are secured to the drum by means of a strong adhesive 54 which has sufficient bond strength to resist the strong radially outwardly directed G-forces imposed upon the magnets as the drum rotates. Suitable adhesives for this purpose are commercially available and may be selected by those skilled in the art. In addition, the rotor-magnet surfaces are covered with a suitable plastic and fiberglass or the like type of coating 55 (see FIG. 5) which covers the exposed surfaces of the magnets and fills the slight gaps between each row of magnets.

Figure 8:
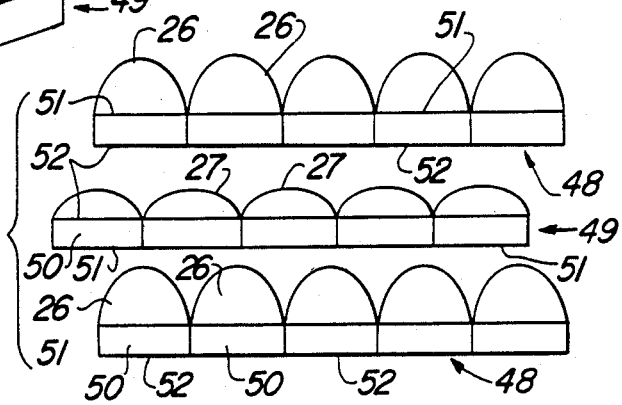
FIG. 8 is a schematic diagram of the relative magnetic fields of three adjacent rows of magnets.
Figure 10:
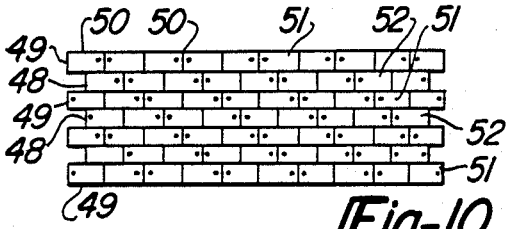
FIG. 10 illustrates a portion of a series of rows of permanent magnets affixed upon the rotor surface.

The magnets in each row are preferably arranged in end to end contact. The adjacent rows are arranged close together, but some small gap is provided between the rows to accommodate to the curvature of the drum. As mentioned, these small gaps are filled with the cover-filler material 55. The arrangement of the adjacent rows of magnets is schematically illustrated in FIG. 10 which shows the individual magnets in each row arranged with like polarity adjacent (represented by the dots at the ends of the magnets) and with the rows alternating with respect to the arrangement of the stronger and weaker faces 51 and 52 of their magnets. Thus, as schematically shown in the diagram of FIG. 8, the separate magnetic fields 26 of the individual magnets of one row 48 are higher and extend further outwardly, relative to the drum wall, than the separate fields 27 of the individual magnets in the next adjacent row 49. Also, since the rows are longitudinally offset relative to their adjacent rows, the separate fields of each magnet in one row are longitudinally offset relative to the magnets in the next adjacent row (see FIG. 8).

Figure 9:
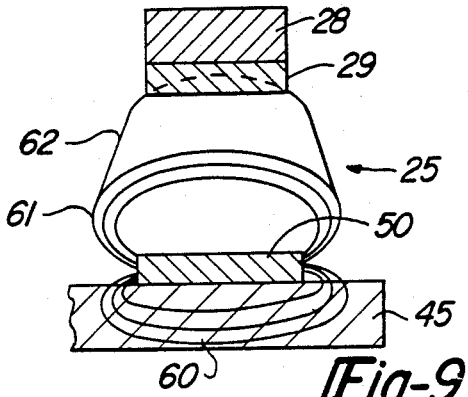
FIG. 9 is an enlarged, schematic view showing the distortion of the magnetic field of a single magnet, affixed upon the rotor, and located beneath the dipole.

The shapes of the magnetic fields of the magnets are distorted by the iron wall of the drum. Thus, as shown in FIG. 9, the magnetic field or flux lines 60 of the inner faces of the magnets are compressed by the drum wall, while the field or flux line 61 of the outer faces of the magnets are expanded away from the drum. The flux in the composite field portion located beneath the dipole 28 is further expanded radially outwardly from the drum, by the effect of the row of dipole magnets 29. That is, the dipole attracts the field portion 62 located beneath it to enlarge the field and thereby, maintain a greater flux density in the composite magnetic field area 25 through which the pieces pass before being released for free travel off the end of the belt.

The dipole magnets 29 may be the same kind of permanent magnets as are affixed to the drum wall 45. The magnets may be fixed upon the dipole bar by adhesive and arranged end to end with each end being of opposite polarity to its adjacent magnet end. Preferrably, the iron bar's thickness is about twice the thickness of the magnets.

Figure 3:
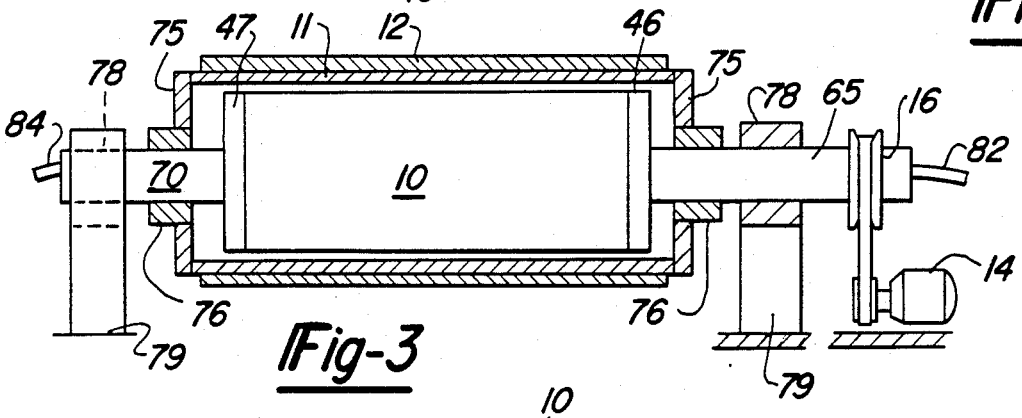
FIG. 3 is a partial, cross-sectional view of the rotor, the surrounding conveyor pulley and the rotor mounting.

The rotor is rotatably supported on the end by a rotor support, intake shaft 65 (see FIGS. 3 and 4). This shaft has a coolant intake bore 66 of a relatively small diameter, which communicates with an intake bore portion 67 of a larger diameter. The bores open to the interior of the drum through an aligned opening 68 formed in the adjacent rotor end plate 46. Similarly, the opposite end of the rotor is supported by a rotor support, outlet shaft 70, which has a larger outlet bore 71 that communicates with an aligned opening 72 in its adjacent rotor end plate 46.

The conveyor tail pulley 11 is provided with end plates 75 having bearings 76 for mounting the pulley upon the rotor shafts 65 and 70. Thus, the conveyor pulley may be rotated at different, much slower, speeds than the rotational speed of the rotor.

The rotor shafts extend through suitable shaft support bearings 78 mounted upon fixed stanchions 79. As earlier mentioned, shaft 65 is connected to the rotor drive motor 14 by a pulley 16, which is schematically illustrated in FIG. 3.

During rotation of the rotor, considerable heat is generated by the magnetic field operation. This heat can ruin the permanent magnets. Therefore, the rotor is cooled by fluid, such as water, conveyed through a suitable inlet pipe 82, through the intake shaft bores 66 and 67, through the opening 68 in the rotor end plate 46 and into the hollow drum. The fluid centrifugally spreads around, and coats, the inner surface of the rotor drum wall to a level or depth shown by lines 83 in FIG. 4. When that level or depth substantially equals the distance between the drum inner wall surface and the peripheral edge of the outlet opening 72 in the opposite plate 47, the fluid spills out through the outlet bore 71 from which it is removed by a suitable exhaust hose or tube 84. Thus, a liquid coolant, such as available tap water, may be circulated through the drum at all times to maintain a low enough drum temperature to avoid damage to the magnets due to heat build-up. The varying diameters of the intake bores 66 and 67 in the shaft 65 prevents back-up or back spilling of the water through the intake shaft. The number of changes in the bore diameter may be varied for this purpose. Likewise, the outlet bore may be suitably formed in different size bores or bore sections to prevent back flowing of the outlet water.

OPERATION

Essentially, the separation process involves subjecting a normally non-magnetically responsive piece of material to a very rapidly changing, high flux density magnetic field which momentarily induces an eddy current in the piece. This, in turn, develops a magnetic force in the piece which repels the piece from the magnetic field. The magnitude of eddy current and the resultant magnetic force that is developed within each piece varies with different types of non-ferrous metals. Thus, with all other conditions being equal, different pieces of different metal composition will tend to repel a different distance away from the magnetic field. That is, the distances that the different pieces move away from the magnetic field can be correlated to the nature of the non-ferrous-metal material from which the piece is made.

Each piece has an initial or starting speed, which results from moving the piece along the conveyor surface before releasing it for free travel. The momentum of the piece causes the piece to continue moving off the conveyor along a forwardly directed path. Gravity causes the path to form a downwardly directed trajectory. Then, the differing magnetic forces induced in the different non-ferrous-metal pieces adds to the length of the trajectory. The different lengths are correlated to the magnitude of the induced eddy current caused magnetic force.

The magnitude of the induced eddy current is also dependent upon the amount of surface area of the piece. In addition, the size of the piece, i.e., its mass, has an effect upon the length of its trajectory of travel. Consequently, it is desirable to pre-sort a mixture of different pieces into groups of approximately the same size so that the pieces in each group can then be further separated by the magnetic phenomenon.

Figure 12:
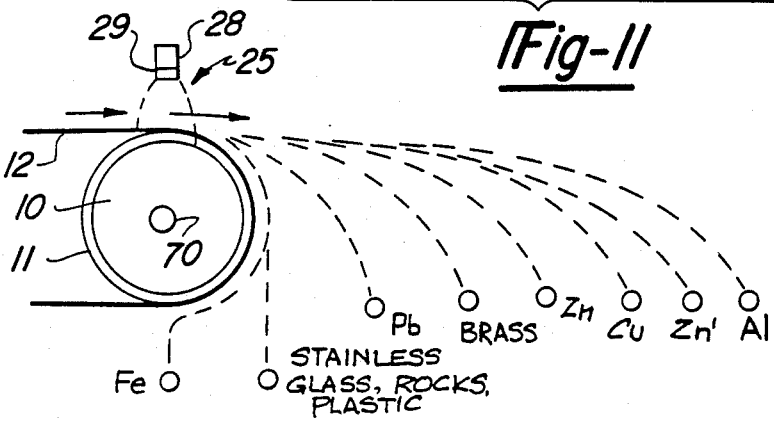
FIG. 12 diagramatically illustrates the relative separation of pieces of different kinds of materials.

The separation of the pieces in response to the magnetic effect is diagramatically illustrated in FIG. 12. Assuming all of the pieces are of the same size and that the starting speed of movement off the conveyor is the same for all the pieces, and the rotational speed of the rotor is the same (which affects the magnetic field frequency of change), and the location of the dipole is the same, FIG. 12 diagrams the relative separation of the different materials after passing through the magnetic field. Assuming that aluminum is assigned an arbitrary value of 100, then copper will have a displacement of length of trajectory of about 50.4. Zinc will equal about 18.3; brass will equal about 13.0 and lead will equal about 3.1.

Stainless steel, glass, rocks and plastic will essentially drop down with little or no trajectory. Iron pieces, which have not previously been magnetically removed, such as by electromagnets, will tend to remain with the surface of the conveyor as it loops around the magnetic rotor until reaching near the lowest point on the curve, at which time gravity will cause the iron piece to fall downwardly.

Due to the nature of typical automotive scrap metal, zinc pieces are usually less massive than corresponding pieces of copper and the like. In addition, the magnetic field supplies only about 25% saturation of an eddy current, so that the displacement of the zinc, which has less mass per surface area, actually may be further than theoretical calculations. That is, the zinc, indicated as Zn', tends to locate between the aluminum and the copper rather than the theoretical location of between the copper and the brass. This is illustrated by the Zn' location in FIG. 12.

In order to get the needed magnetic field magnitude, permanent magnets made of commercially available neodymium iron boron material are preferred. That material can provide a strong magnet having about a 5000 gauss flux density at its surface. Moreover, one of its flat surfaces tends to be magnetically stronger than its opposite surface, as earlier mentioned in connection with this type of magnet. The magnet may be shaped like a flattened rectangular block, similar to a domino in shape, about one inch long, ½ inch thick and ⅝ inch wide. A single row may be on the order of about 36 magnets long, with about 48 rows used for an approximately 10 inch diameter rotor drum that is roughly 46 inches long. The rotor is longer than the row so that the ends of the rows are spaced from the ends of the rotor.

As is known, flux density decreases with the increase of distance from a magnet. Hence, in order to provide a high flux density at the location where the pieces pass above the rotor, the conveyor tail pulley is made of a drum which is closely spaced relative to the surface of the rotor. For example, a ⅛ inch spacing may be maintained between the inner surface of the conveyor belt and the outer surface of the magnet covered rotor drum. The pulley is preferably made of a thin, structurally strong, but magnetically impervious material. For this purpose, it has been found that making the pulley drum of a plastic material, such as "Kevlar", a DuPont trademarked material sometimes called "ballistic cloth", with suitable resin content, provides a thin wall, strong, accurately dimensioned drum to form the pulley. As an example, the pulley may have a wall thickness of about 1/16 inch.

The belt of the conveyor should be made of a suitable flexible, thin, strong, and magnetically inert material. While the thickness of the belt may vary, an example may be of about 1/16 inch. Thus, the magnetic field 25 extends upwardly above the belt, to the dipole, to create the relatively dense flux through which the workpiece is passed. The density and height of the flux field can be adjusted by raising or lowering the dipole relative to the conveyor belt surface.

With the rotor example described above, the rotor drum has a nominal 10 inch diameter. Thus the rotor outer diameter is increased, by the thickness of the magnets, the adhesive, and the coating upon the magnets, to close to 12 inches. When this rotor is rapidly rotated, at about 1200–1400 rpm, and up to about 2200 rpm, the rotation can cause the magnets to be affected by an approximately 900 G-force. This force is handled by using a high strength adhesive which adheres each magnet to the surface of the iron rotor. As mentioned, suitable adhesives are commercially available for this purpose.

As an example of the speed of operation, assuming a one inch long piece, a conveyor belt speed of about 50 ft. per minute, and rotating the rotor at about 1800 rpm, the time for a piece to travel through the magnetic flux field will be about 0.1 seconds per inch. This is calculated at 50 ft. per minute X 12 inches per ft. = 600 inches per minute, divided by 60 seconds per minute = 10 inches per second.

The polarity reversals of the magnetic field which occurs in the 0.1 seconds during which the piece travels through the field equals 144 reversals. This is based upon 1800 rpm × 48 field reversals per revolution (based upon 48 rows around the circumference of the rotor drum, with the rows essentially parallel to the axis of the rotor). This results in 86,400 reversals per minute, divided by 60 seconds, which equals 1440 reversals per second, divided by 10 (inches per second), which results in 144 magnetic field reversals per piece or 1440 cycles per second.

With this operation, the drum tends to heat and could exceed 1200° F. in temperature. That would ruin the permanent magnets and cause them to lose their magnetism. For example, the Curie point of neodymium-iron-boron magnets is about 450° F. Above that temperature, the magnetics are lost. Thus, the drum must be cooled to preferably below 150° F. or essentially ambient temperature for safety's sake and to maintain good operation by continuously flowing tap water through the drum. The amount of water run through the drum can be varied by observation to maintain a relatively low temperature.

Figure 11:
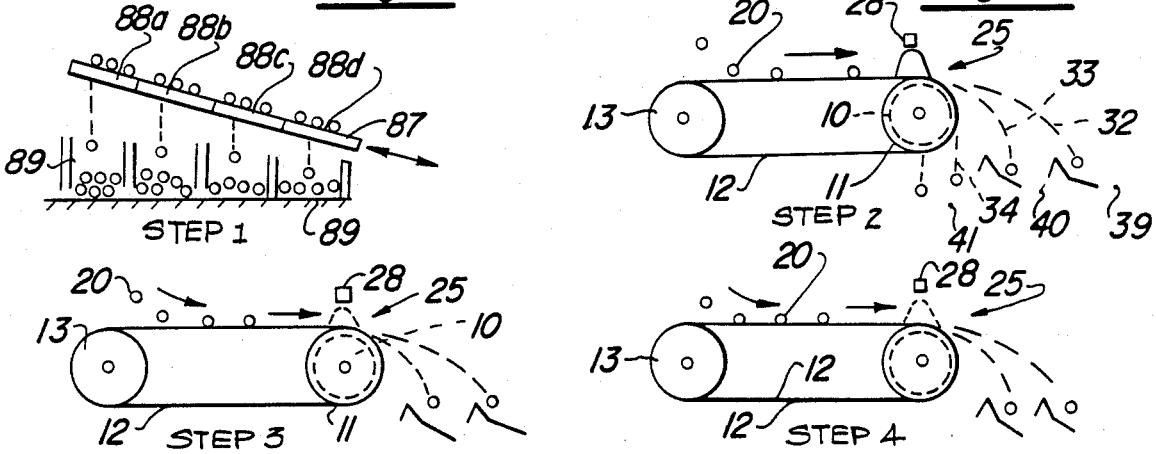
FIG. 11 schematically illustrates a series of four steps in the sorting of a mixture of pieces.

FIG. 11 illustrates the steps in the complete operation of sorting a mixture of diverse pieces. These pieces may come from an automobile shredder or similar breaking machine which breaks and shreds metal into relatively small sizes. Because mass and surface area affect the magnetic sortation, step 1 invlves screening the metal pieces into different size categories. For that purpose, the metal pieces may be moved along a screen 87, of the vibratory type, which has a number of sections. Each section has a screen which will pass certain size pieces, with each successive section passing larger size pieces. For illustration purposes, the screen in step 1, FIG. 11, is provided with four different size sections, 88*a*, 88*b*, 88*c* and 88*d*, each of which successively passes larger pieces. These pieces all into separate collection hoppers 89 or upon removal conveyors.

Once the pieces are sorted by different size categories, the magnetic sortation begins with one of he size categories. Thus, step 2 shows the dropping of the pieces 20 upon the upper surface of the conveyor belt 12 where the pieces are rapidly conveyed through the rapidly reversing magnetic field 25 located above the rotor and beneath the dipole 28. For illustration purposes, three trajectories, i.e., numbers 32, 33 and 34 are shown. Here, the metal pieces separate, not completely by the different metallic composition of the pieces, but rather by all the factors that affect the piece movement, e.g., size, shape,surface area, and metal composition. That is, different sub-categories of pieces are separated by the different trajectories, but in sub-categories that comprise a mixture of different metal pieces that respond about the same way. The nonmetallic pieces, i.e., glass, stones, plastic pieces, as well as stainless steel, drop down. Meanwhile, any ferrous material caught in the mixture tends to separate out by dropping directly down from the lowest location of the rotor.

Next, step 3 involves passing one of the sub-categories through the equipment again or through another line of similar equipment. This time, the material will tend to separate bymetallic type content. For ease of handling, and to simplify the equipment and operation, it may be desirable to divide the pieces into only two or three different metal content sub-sub-categories, each of which may comprise more than one metal composition. These categories may then be passed again through the equipment or through another line, as shown in step 4, to further separate into specific types of metals. The sortation process may be repeated one or more times until finally the pieces are divided by their metallic content. Once that is accomplished with one particular category of pieces from the screening step, No. 1, the next size category can be magnetically sorted. Actually, in production, it is desirable to use about five magnetic sorting lines, so that after the step 1 screen size sortation, the metal pieces are passed through repeated steps, each being a sorting line. The sorting lines can be arranged end to end, that is, with each receiving pieces from the preceding sorting line.

Although the size and number of magnets for the rotors may vary, utilizing equipment of approximately the size described in the example above, with five conveyor-rotor units arranged end to end to receive pieces one from the next, it has been found that about six million pounds of mixed scrap can be handled per month with a normal shift. The production can be increased by running the equipment around the clock.

It should be noted that when the material is passed from one magnetic sortation line to the next, the amount of magnetic force developed in the pieces, that is, the amount of eddy current induced in the pieces, may be varied for each line by varying the rotational speed of the rotor, the linear speed of the conveyor and the distance between the dipole and the surface of the rotor. Thus, by adjusting these three items, the sortation of pieces run through the equipment at any particular time can be adjusted for separating different kinds of pieces. Such adjustment must be done initially by operator trial and error experience and close observation to work out precise parameters for each condition encountered on a specific unit. Once these paramenter are determined for particular conditons, the performance of the equipment and the sortation results are predictable and repeatable.

This invention may be further developed within the scope of the following claims.

Having fully described an operative embodiment of this invention, we now claim:

1. A method of sorting mixed pieces of roughly similar size, which are formed of different non-ferrous metals, comprising essentially the steps of:

physically moving the individual pieces upon a conveyor surface at a predetermined speed in a predetermined direction through a rapidly changing, high flux density magnetic field, sufficient to develop a magnetically induced repulsive force in the pieces which force differs in magnitude for the different non-ferrous metals;

forming the rapidly changing magnetic flux field by placing a rotating drum close to, but beneath, the conveyor surface, with numerous, tile-like, high flux density, permanent magnets affixed upon the drum surface, with each magnet providing a separate magnetic flux field, so that the overall magnetic field of the rotating drum rapidly changes as the magnets move with the drum surface;

forcing the magnetic field upwardly, generally radially away from the drum surface to vary the flux density enveloping the pieces located upon the conveyor surface as they pass over the drum, by means of placing a variable height adjustable, magnetic flux attractive dipole above the conveyor surface and pieces;

adjusting the flux density enveloping the pieces by adjusting the dipole height to predetermined locations;

permitting the pieces to freely continue to travel along an unsupported, downward trajectory along said direction, without support, immediately after passing through said field, under the combined influence of the forces of inertia, gravity and said magnetically induced repulsive force;

whereby the distance that each of the pieces travel from their departure from the magnetic field is affected by its developed magnetically induced repulsive force, so that the different metal pieces separate from each other along their length of travel;

and collecting the separated pieces of metal.

2. A method as defined in claim 1, and including moving the pieces by placing them upon an adjustable speed moving conveyor surface, and preselecting such speed to develop a predetermined speed of piece movement through the magnetic field and at the start of the unsupported travel trajectory of the piece.

3. A method as defined in claim 1, and including increasing the flux density in the magnetic field enveloping the pieces, by forming the drum with an iron wall whose thickness is at least about twice the thickness of the permanent magnets, to distort, i.e., flatten, the magnetic field at the wall and thereby cause the field to extend radially outwardly of the drum at the free surfaces of the magnets.

4. A method as defined in claim 1, and including forming the magnetic flux field as a composite of discrete, parallel rows of adjacent, separate, end to end arranged small magnetic fields, by arranging the permanent magnets in separate rows, with each row comprising numerous magnets arranged end to end and with their like polarity ends adjacent, and longitudinally offsetting the adjacent rows, relative to each other, to offset the small magnetic fields in one row relative to the next adjacent row.

5. A method as defined in claim 1, and including, cooling the drum by continuosly flowing cooling liquid into one end of the drum through an inlet bore which is coaxial with the drum, with the liquid centrifugally coating the interior wall of the drum, and continuously removing the liquid through an outlet bore formed in the opposite end of the drum, coaxially with the drum, which outlet bore has a larger diameter than the inlet bore for enabling the liquid to spill out through the outlet bore as the thickness of liguid coating exceeds the distance between the circular edge defining the outlet bore and the interior wall of the drum.

6. A method as defined in claim 1, and including pre-screening the mixture of pieces to be sorted to initially sort them into predetermined size categories before proceeding with the above-defined sorting steps for each size category;

and following the above-defined sorting steps, removing pieces that are not formed of non-ferrous metals, as for example, ferrous metal pieces, plastic, rocks, glass and the like, which drop downwardly with little or no travel trajectory as compared with the trajectory lengths of non-ferrous metal pieces;

repeating the above-defined sorting steps with at least one of the groups of separated, collected, non-ferrous metal pieces for further sorting of such pieces.

7. A magnetic sorter for separating mixtures of pieces of different non-ferrous metals, comprising:

a horizontally axised, rotor formed of a cylindrical drum having parallel rows of a number of permanent magnets secured to its outer surface;

the magnets in each row being arranged end to end with like polarities at adjacent ends;

means for rotating the drum about its axis;

a support surface located closely above the drum and within the magnet field above the drum for supporting pieces of metal that are moved on the support surface over the drum transversely of the drum axis;

the magnetic field of the magnets being arranged so that the metal pieces passing over the drum, pass through the field and are momentarily subjected to a rapidly reversing magnetic flux field of sufficient magnitude to induce a magnetic repelling force in each piece, but with the magnitude of the repelling forces varying with different types of non-ferrous metals;

and piece collecting means located at the end of, and below the level of, the support surface so that unsupported pieces may freely continue to move, due to their momentum, in the direction of their movement across the drum and thereafter, drop downwardly due to gravity upon the collecting means, with pieces of different metals tending to separate from each other along their direction of travel, due to their respective, magnetically induced, repelling forces.

8. A magnetic sorter as defined in claim 7, and including the magnets in each row being formed in a flat, tile-like shape;

the adjacent rows of magnets being longitudinally offset relative to each other so that the ends of the magnets in one row are longitudinally offset relative to the magnets in the next adjacent row, to correspondingly longitudinally offset the magnetic fields of each individual magnet relative to the field of the magnets in the next adjacent rows;

whereby during rotation of the rotor, the magnetic flux field varies, with a predetermined frequency depending upon the speed of rotation of the rotor, relative to the support surface as each row moves beneath and relative to the support surface.

9. A magnetic sorter as defined in claim 7, and including the support surface comprising an endless conveyor belt having a thin wall, tail pulley surrounding and coaxially arranged relative to the drum, and a head pulley located remotely from the tail pulley;

means for rotating the drum about its axis and means for driving the conveyor belt at a speed considerably slower than the drum speed of rotation.

10. A magnetic sorter as defined in claim 9, and said rotor drum being hollow and being formed with a thin wall formed of an iron material, which forces the magnetic field of the magnets in a direction outwardly of the drum so that the magnetic field on the exposed faces of the magnets extend radially, relative to the drum, further away from the magnets than does the field of the magnetic surface at the drum surface.

11. A magnetic sorter as defined in claim 10, and including an elongated magnetically attractive dipole extending parallel to, and above, the axis of the drum and located above the conveyor belt, with said dipole drawing the magnetic field of the rows of magnets upwardly towards itself to increase the height of the magnetic field portion through which the pieces pass.

12. A magnetic sorter as defined in claim 11, and including said drum being mounted upon coaxial, hollow end shafts for rotating the drum, with said hollow shafts each being centrally bored, and with one shaft being a coolant liquid intake shaft having the diameter of its bore considerably smaller than the diameter of the bore of the other shaft, which forms a coolant outlet shaft;

wherein liquid coolant flows into the inlet shaft and centifigually spread over the interior wall surface of the hollow drum to line the surface to a predetermined depth corresponding to the distance between the wall defining the larger bore of the outlet shaft and the interior wall surface of the hollow drum, wherein the liquid overflows out of the outlet shaft bore for thereby continuously circulating coolant liquid through the drum.

13. A magnetic sorter rotor for producing rapidly reversing magnetic flux fields comprising:

a cylindrical drum having an outer surface and a central axis;

numerous, parallel rows of permanent magnets secured to the outer surface, with each row formed of a number of similar, relatively small, permanent magnets, each arranged end to end with the adjacent magnet and with the adjacent ends of the respective magnets being of the same polarity;

with each row of magnets being longitudinally offset relative to its next adjacent row to offset the ends of the magnets in one row from the ends of the magnets in the next adjacent row;

said drum being rotatable around its axis, whereby the rotating drum provides a series of separate flux fields along its axial length, corresponding to each magnet in each row, which flux fields rapidly reverse relative to a fixed line that is parallel to said center axis and which is located adjacent the drum surface.

14. A magnetic sorter rotor as defined in claim 13, and said drum being formed of a ferrous metal material which distorts the magnetic fields of the magnets to cause the respective magnetic flux fields to extend outwardly, away from the surface of the rotor a greater distance than the distance the magnetic field extends inwardly of the rotor;

and said drum having a hollow interior.

15. A magnetic sorter rotor as defined in claim 14, and said individual magnets being formed in an elongated, flat, tile-like shape and each magnet having one of its larger faces permanently affixed to the surface of the drum.

16. A magnetic sorter rotor as defined in claim 15, and said magnets each having one of its larger surfaces, having a greater magnetic field strength than its opposite larger surface;

and the magnets in each row being arranged so that the greater magnetic field surfaces of each row are coplanar, but with the greater surface, greater magnetic fields of each row alternating relative to the next adjacent row so that one is adjacent the drum surface and the next row is exposed relative to the drum surface.

17. A magnetic sorter rotor as defined in claim 14, and including the opposite ends of the drum being closed and hollow mounting shafts, coaxially arranged relative to the drum axis, extending axially outwardly relative to the closed ends of the drum, with the hollow interiors of the shafts communicating with the hollow interior of the drum for flowing a liquid coolant through the shafts and the drum for cooling the drum while it is rotating.

18. A magnetic sorter rotor as defined in claim 17, and including said hollow shafts each having central bores, with the bore in one shaft being of a greater diameter than the bore in the other shaft, and with the shaft of the lesser diameter bore forming a coolant liquid inlet shaft and the shaft with the greater diameter bore forming a coolant outlet shaft;

wherein liquid coolant flows through the inlet shaft bore for centrifugally spreading over the interior wall surface of the hollow drum for thereby, lining the drum interior surface to a depth substantially equal to the distance between the drum interior wall and the wall defining the larger shaft bore, so that the liquid overflows out through the outlet shaft large bore for continuously circulating coolant liquid through the drum.

* * * * *